US008437948B1

(12) United States Patent
Balasundaram et al.

(10) Patent No.: US 8,437,948 B1
(45) Date of Patent: May 7, 2013

(54) TRAFFIC FORECASTING

(75) Inventors: Alan Balasundaram, Renton, WA (US); Kevin Foreman, Sammamish, WA (US); Rajiv Nandivada, Bothell, WA (US); Ka Wang Yee, Renton, WA (US)

(73) Assignee: INRIX, Inc., Kirkland, WA (US)

( * ) Notice: Subject to any disclaimer, the term of this patent is extended or adjusted under 35 U.S.C. 154(b) by 0 days.

(21) Appl. No.: 13/445,838

(22) Filed: Apr. 12, 2012

(51) Int. Cl.
*G08G 1/00* (2006.01)

(52) U.S. Cl.
USPC ..... 701/117; 701/118; 701/119

(58) Field of Classification Search ..... 701/117, 701/118, 119
See application file for complete search history.

(56) References Cited

U.S. PATENT DOCUMENTS

2006/0064235 A1* 3/2006 Ishikawa et al. ..... 701/117

* cited by examiner

*Primary Examiner* — Mary Cheung
*Assistant Examiner* — Yuen Wong
(74) *Attorney, Agent, or Firm* — Cooper Legal Group LLC

(57) ABSTRACT

Among other things, one or more techniques and/or systems for forecasting traffic and concurrently presenting images of forecasted traffic are disclosed to facilitate more efficient departure and/or navigation by providing an outlook of anticipated traffic flow for an area and/or a route (e.g., associated with an origin and destination), for example. A predicted traffic pattern and/or associated navigation may be provided and/or generated based upon traffic data (e.g., historical traffic data, current traffic data, and/or predicted traffic data). Additionally, a suggested departure time may be provided to mitigate travel time to and/or from a destination, for example. Accepted suggestions may be associated with predicted traffic data to update predicted traffic patterns (e.g., predicted traffic data) thereafter. Accordingly, travelers may be provided with traffic forecasting to enable more desirable travel experiences (e.g., shorter travel times).

20 Claims, 10 Drawing Sheets

TRAFFIC FORECASTING

BACKGROUND

Within the field of computing, route navigation may comprise receiving a destination and providing an estimated travel time and navigation instructions (e.g., turn by turn directions) thereto. For example, an application may provide directions and/or a map to a destination based upon a location (e.g. origin) of a traveler (e.g., a current location for the traveler). Such an application may, for example, execute on a location-aware device, such as a smartphone equipped with a global positioning system (GPS), for example. A location aware device may also have access to mapping information and be capable of providing routing information, for example.

SUMMARY

This Summary is provided to introduce a selection of concepts in a simplified form which are further described below in the Detailed Description. This Summary is not intended to identify key factors or essential features of the claimed subject matter, nor is it intended to be used to limit the scope of the claimed subject matter.

Among other things, one or more techniques and/or systems for traffic forecasting are disclosed to facilitate more efficient departure timing and/or navigation by providing an outlook of anticipated traffic flow (e.g., a predicted traffic pattern) for an area and/or a route (e.g., associated with travel from an origin and destination), for example. It may be desirable for a traveler (e.g. commuter, user of a global positioning system and/or device (GPS), driver, biker, pedestrian, etc.) to mitigate and/or reduce an amount of time spent on the roadway and/or in traffic (e.g., therefore potentially increasing an amount of time for personal utility), for example. In one embodiment, a traveler may enter an input location and be provided with a predicted traffic pattern. The predicted traffic pattern may be associated with navigation (e.g., turn by turn directions and/or be specific to a route for a traveler) and may be based upon traffic data (e.g., historical traffic data, current traffic data, and/or predicted traffic data), for example. Additionally, a suggested departure time may be provided to mitigate travel time to and/or from a destination, for example. The suggested departure time may be based on predictions, estimations, and/or simulations associated with reducing travel time by modifying a departure time to mitigate encounters with traffic (e.g., avoid traffic jams), for example.

In one embodiment for forecasting traffic, an input destination may be received and/or accepted, and a corresponding route may be calculated (e.g., a route from an origin location to the input destination may be determined). For example, if an input destination of "home" is received, a route comprising turn by turn navigation from a current location to home may be generated. In one embodiment, a set of predicted traffic data (e.g., traffic data) associated with the input destination and/or route may be generated and/or analyzed for a corresponding future departure time. For example, traffic associated with a route and/or input destination may generally be heavy (e.g., based on historical traffic data) at five o'clock (e.g., a first future departure time) but may be lighter at six o'clock (e.g., a second future departure time). To this end, a predicted traffic pattern may be generated to reflect such activity for the route. As another example, if a professional sporting event is scheduled to end around eight o'clock, a predicted traffic pattern may be generated and/or analyzed to reflect activity which may occur on associated roadways (e.g., in response to the sporting event traffic, for example). Additionally, a set of current traffic data (e.g. indicative of real time activity on a roadway, for example) associated with the input destination may be analyzed. For example, if a traveler utilizes a route from an origin location to a destination location, and the route comprises a roadway with a traffic accident, current traffic data may be analyzed and/or generated to reflect the accident accordingly (e.g., a status of the accident, a time the accident began, a type of accident, etc.). To this end, a suggested departure time may be provided, the suggested departure time based on traffic data associated with an input destination. Traffic data may comprise current traffic data (e.g., traffic accidents), predicted traffic data (e.g., based on an anticipated travel plan, sporting event ending, etc.), and/or historical traffic data. For example, if a traffic jam associated with rush hour (e.g., current traffic data) historically clears after twenty minutes (e.g., historical traffic data) along a portion of a route, a predicted traffic pattern (e.g., anticipating the rush hour traffic may clear after twenty minutes) may be provided based on current traffic data and/or historical traffic data.

In another embodiment, one or more traffic patterns (e.g., current traffic pattern and/or predicted traffic pattern) may be displayed and/or presented, for example. That is, for example, a current traffic pattern may be displayed (e.g., a status of traffic activity on a roadway in real time and/or based on recent activity). Additionally, one or more predicted traffic patterns may be generated and/or presented based on one or more corresponding future departure times. For example, predicted traffic patterns and/or estimated travel time may be presented in fifteen minute increments. That is, for example, a traveler may be presented with multiple departure time options (e.g., comprising a travel time estimate, a predicted traffic pattern associated with departure at a current time, a first future departure time fifteen minutes from the current time, a second future departure time thirty minutes from the current time, and/or a third future departure time forty-five minutes from the current time, etc.). In one embodiment, predicted traffic patterns may be color coded to represent a traffic level (e.g., red may represent a severely congested roadway and green may represent a less congested roadway). In one embodiment, the predicted traffic pattern display may comprise traffic information corresponding to an area (e.g., a radius around a GPS device associated with a traveler), zip code, suburb, city, etc. In another embodiment, the predicted traffic pattern display may comprise traffic information (e.g., estimated travel time) for a route (e.g., traffic information associated with turn by turn directions) from an origin location to a destination location, for example.

According to one aspect, a suggested departure time may be provided based on an input destination (e.g., and/or traffic data associated with the input location). For example, if a traveler is commuting from work to home, a suggested departure time of four thirty may be provided based on current traffic data, historical traffic data, and/or predicted traffic data associated with a route for the commute. That is, for example, an estimated travel time for the traveler may be twenty minutes at four thirty and thirty minutes at five o'clock (e.g., based on historical traffic data). Accordingly, a suggested departure time of four thirty may be presented to the traveler. Moreover, in response to a traveler accepting a suggested departure time (e.g., an indication by the traveler that he or she plans to leave at the suggested time and/or an indication of an actual departure in accordance with the suggested departure time), the accepted suggestion may be associated with predicted traffic data to update predicted traffic patterns (e.g., predicted traffic data) thereafter. For example, if a large number of travelers accept a same and/or similar suggested departure time associated with at least a portion of a route (e.g., the travelers plan on driving along a common interstate route around a same and/or similar time), predicted traffic data may be updated accordingly. Therefore, travelers may be provided with a traffic forecast to facilitate more desirable (e.g., reduced) travel times.

To the accomplishment of the foregoing and related ends, the following description and annexed drawings set forth certain illustrative aspects and implementations. These are indicative of but a few of the various ways in which one or more aspects may be employed. Other aspects, advantages, and novel features of the disclosure will become apparent from the following detailed description when considered in conjunction with the annexed drawings.

DESCRIPTION OF THE DRAWINGS

The application is illustrated by way of example and not limitation in the figures of the accompanying drawings, in which like references indicate similar elements and in which.

DETAILED DESCRIPTION

Figure 1:
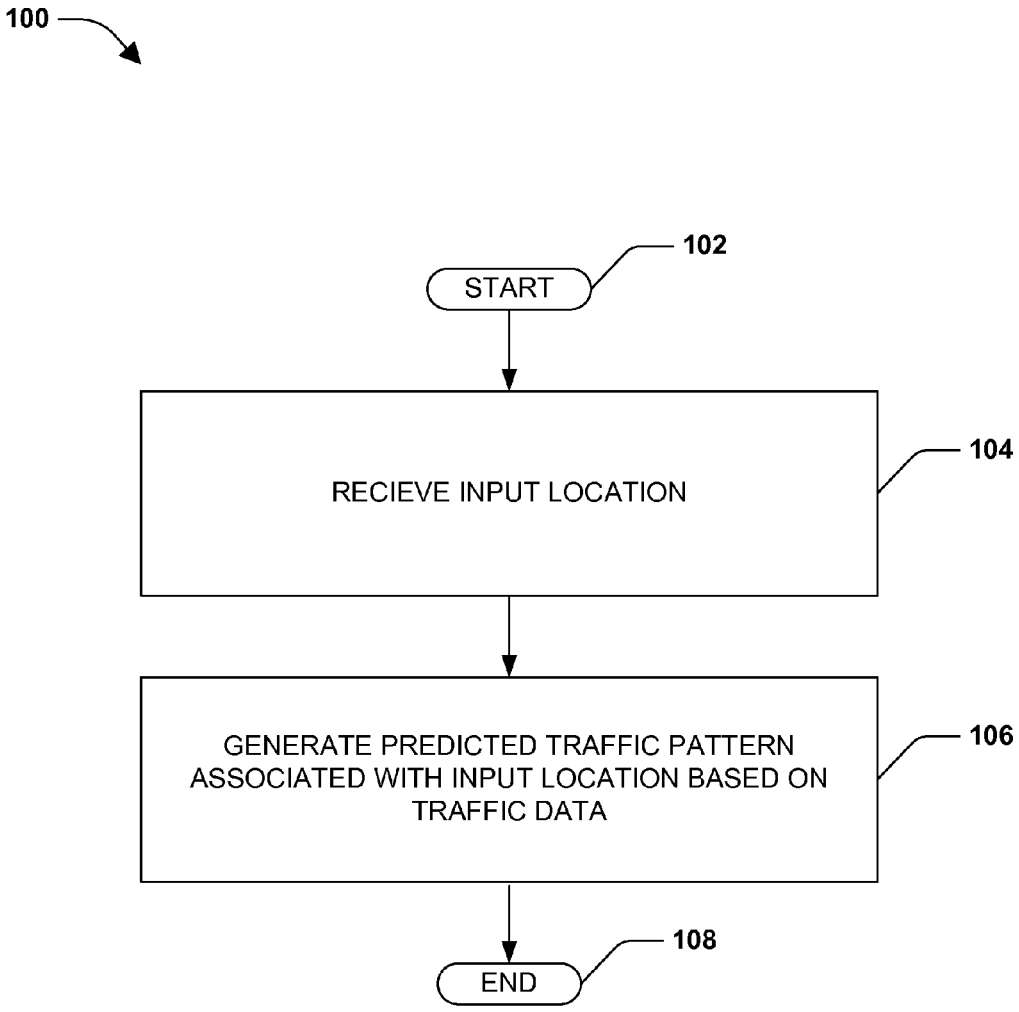
FIG. 1 is a flow diagram of an exemplary method for traffic forecasting.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are illustrated in block diagram form in order to facilitate describing the claimed subject matter.

Among other things, one or more techniques and/or systems for traffic forecasting are disclosed to facilitate more efficient departure and/or navigation, for example. According to one aspect, predicted traffic patterns may be provided to enable a traveler to decide when to leave for a destination, for example. Moreover, predicted traffic patterns may be displayed concurrently (e.g., a juxtaposition of a current traffic pattern and one or more predicted traffic patterns) to educate travelers on relationships between traffic and departure times. Additionally, traffic patterns may be color coded based on a level of congestion, for example. That is, for example, high traffic areas may be designated and/or identified by red, while lower traffic areas may be colored green, and intermediate level traffic may be coded yellow (e.g., or one or more transitions between any colors may be used to illustrate variations in a traffic pattern). A suggested departure time may be provided to facilitate reduced travel time from an origin to a destination, for example. Moreover, if a traveler accepts and/or utilizes a suggested departure time, predicted traffic data may be updated accordingly. It will be appreciated that an input destination and/or location may comprise an area (e.g., zip code, city, radius around a GPS location, etc.) and/or a route (e.g., travel and/or turn by turn navigation from point A to point B).

FIG. 1 is a flow diagram of an exemplary method for traffic forecasting. The exemplary method 100 begins at 102 and may comprise receiving and/or accepting an input location (e.g., a zip code, desired destination, a city, a GPS location, etc.) at 104. The input location may be received from a traveler and/or entered via a GPS equipped device (e.g., a cell phone, car navigation system, etc.), for example. According to one aspect, the input location may be automatically received from a GPS device and/or manually entered (e.g., based on a stationary display in a parking garage, for example). In one embodiment, the input location may comprise an area (e.g., such as a suburb, for example). In another embodiment, the input location may comprise a route from an origin location to a destination location.

Figure 5:
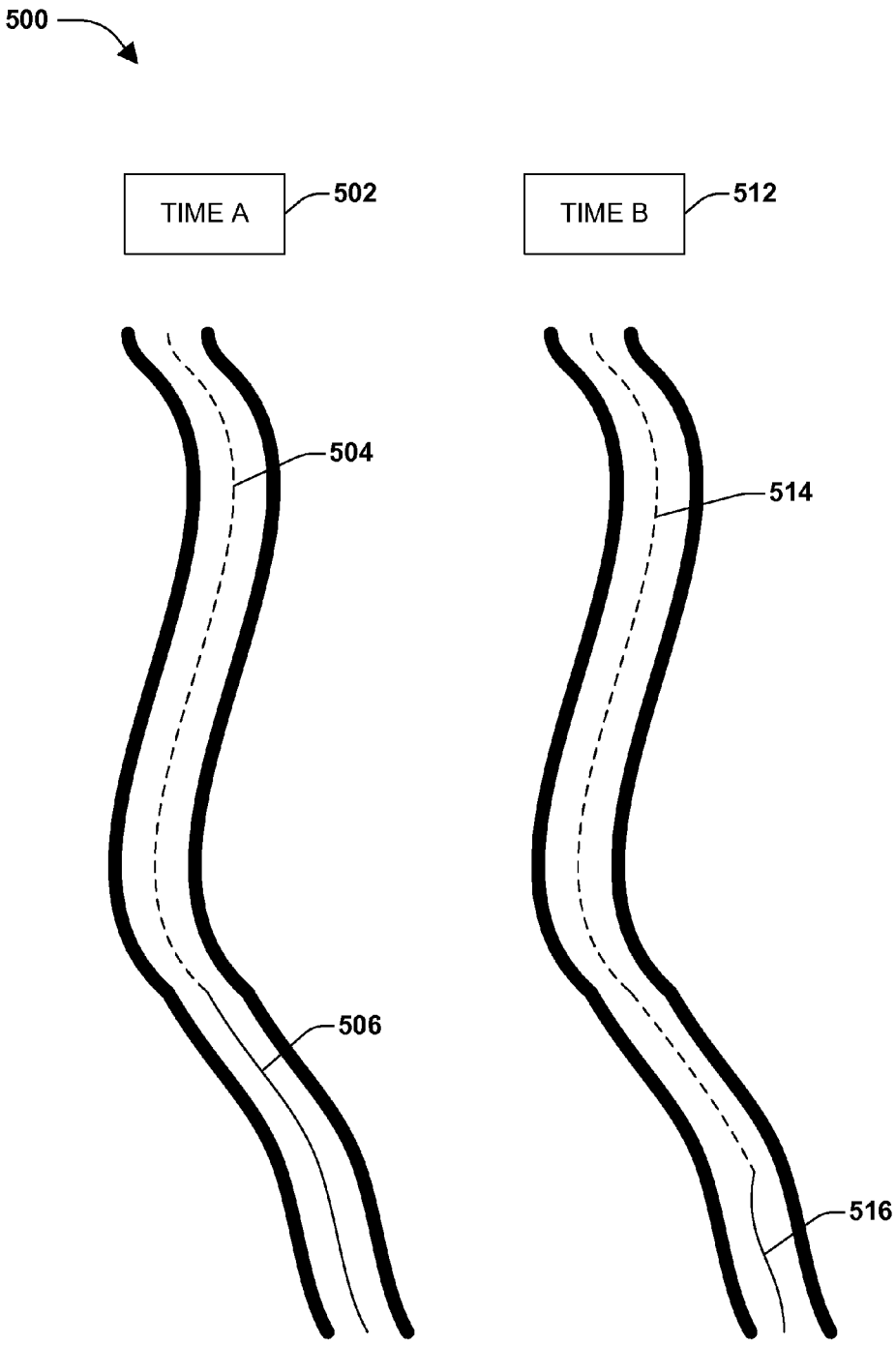
FIG. 5 is a diagram of an exemplary predicted traffic pattern for traffic forecasting.

A predicted traffic pattern may be generated 106 based on input location traffic data (e.g., and/or routes calculated using the input location, etc.), for example. That is, for example, if a traveler enters a sports stadium as an input location, a predicted traffic pattern (e.g. associated with a route from an origin location to the sports stadium) may be generated and/or presented to the traveler (e.g., based on traffic data associated with the input location). To this end, travelers may be provided with details pertaining to anticipated traffic patterns in response to a received input location, for example. In one embodiment, a predicted (e.g., anticipated and/or forecasted) traffic pattern may be provided based on a fifteen minute lag (e.g., or any other interval(s)) from a current time, for example. That is, for example, if a current time is twelve o'clock, the predicted traffic pattern may be indicative of an anticipated status of traffic activity (e.g., associated with a route, etc.) for the input location at twelve fifteen. In one embodiment, a predicted traffic pattern (e.g., as illustrated in FIG. 5) may be displayed on a map, for example.

Figure 6:
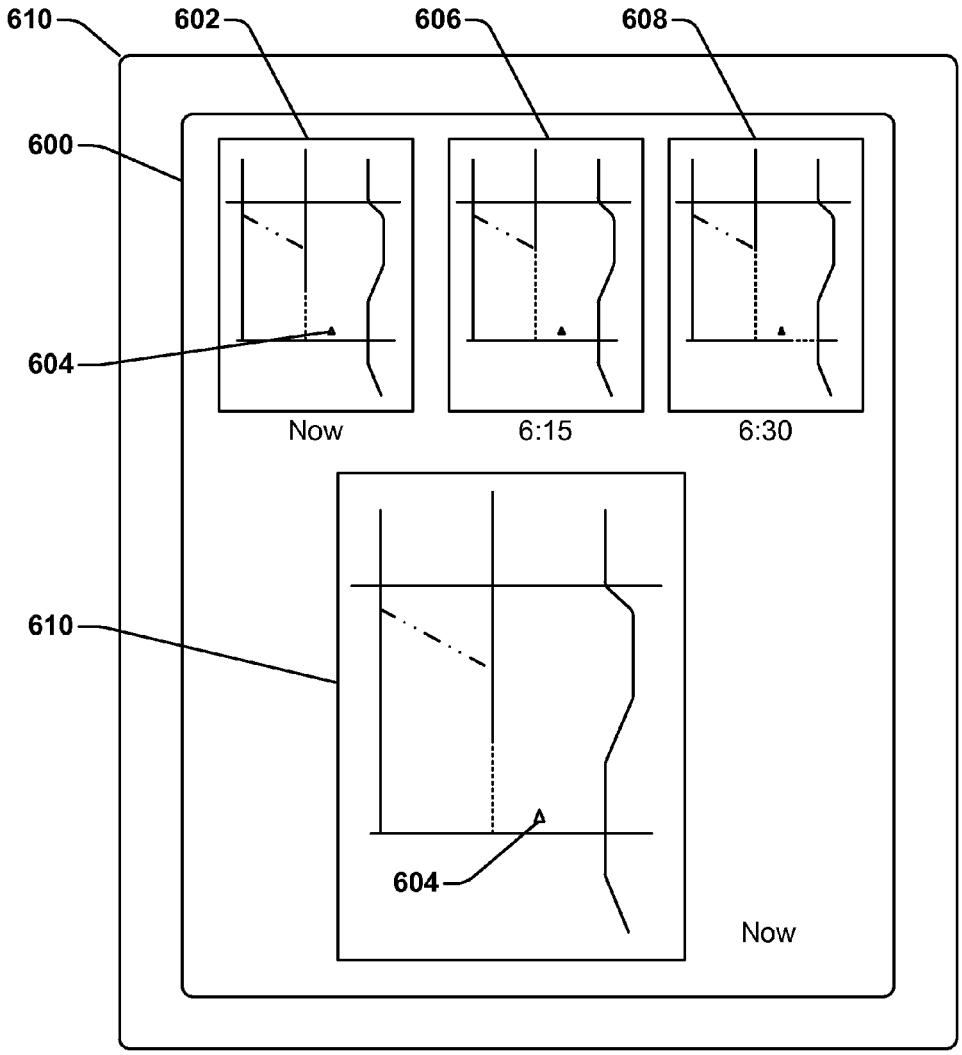
FIG. 6 illustrates an example user interface providing for the concurrent display of two or more maps of a region, where at least one map displays predicted traffic patterns.
Figure 7:
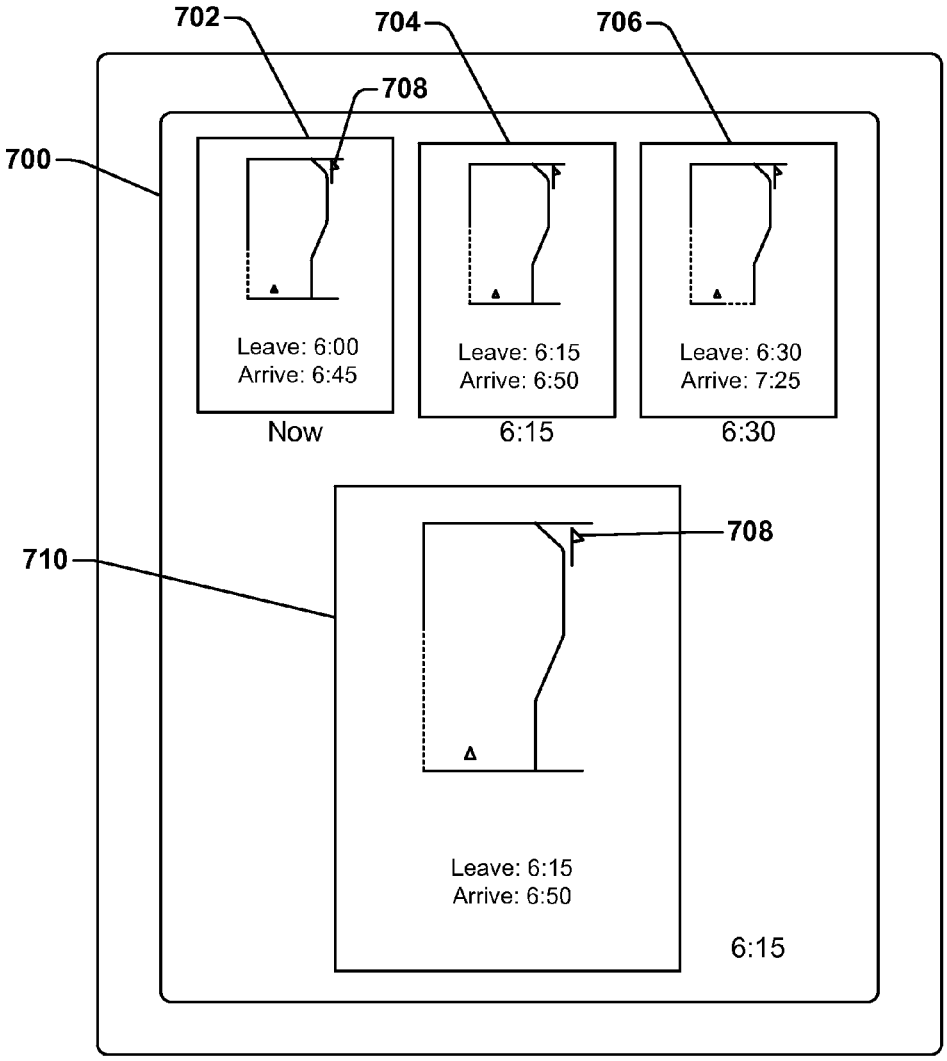
FIG. 7 illustrates an example user interface providing for the concurrent display of two or more maps of a region, where at least one map displays predicted traffic patterns.
Figure 8:
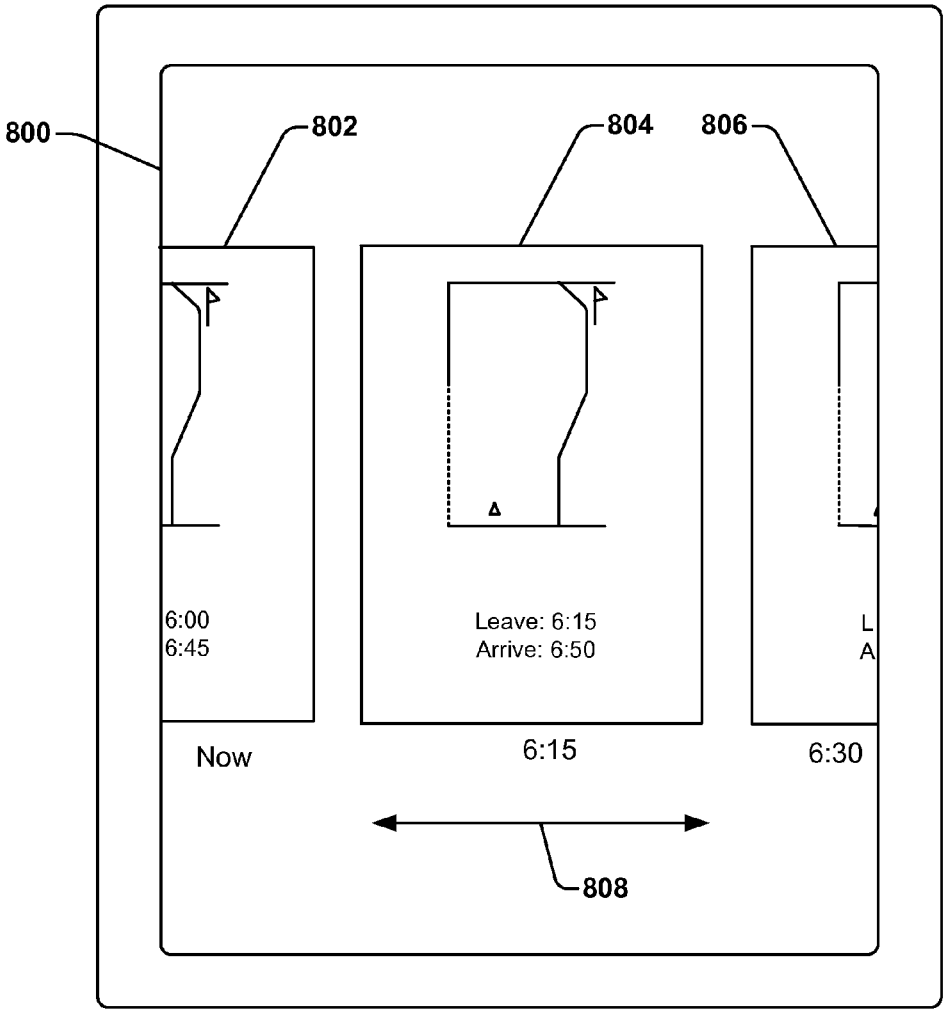
FIG. 8 illustrates an example user interface providing for the concurrent display of two or more maps of a region, where at least one map displays predicted traffic patterns.

As will be further described with respect to FIGS. 6-8, for example, in one embodiment, the predicted traffic pattern may be displayed within a user interface comprising at least two maps, where at least one of the two maps is based upon the predicted traffic pattern. By way of example, a user interface may comprise two maps, where a first map illustrates the predicted traffic pattern and a second map illustrates current traffic information (e.g., based upon real-time and/or predicted traffic data). As another example the user interface may comprise multiple maps, respectively depicting future traffic patterns at different times. For example, a first map may display predicted traffic patterns at 6:00 pm while another map may display predicted traffic patterns at 6:30 pm.

The exemplary method 100 ends at 108 thereafter.

Figure 2:
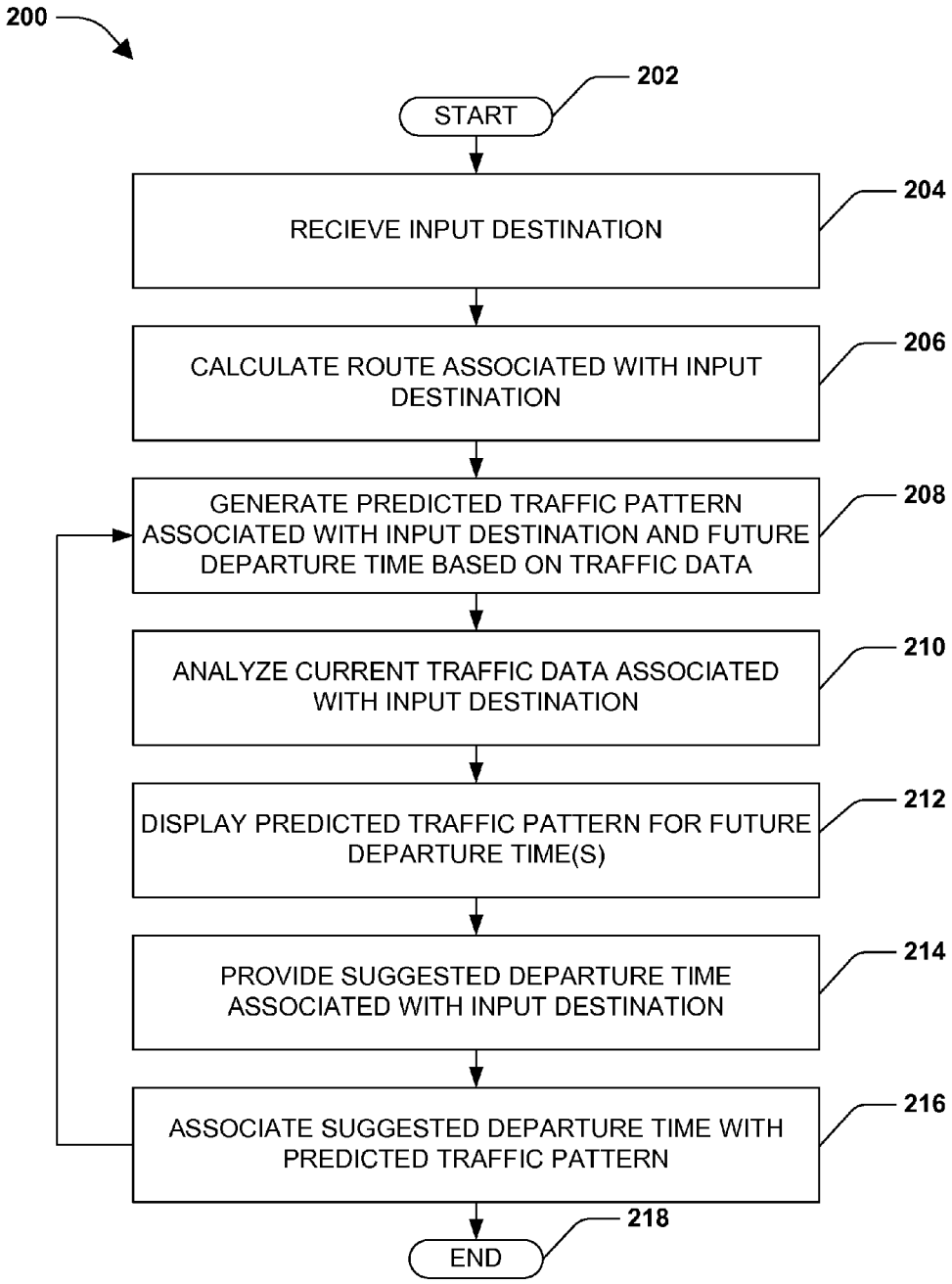
FIG. 2 is a flow diagram of an exemplary method for traffic forecasting.

FIG. 2 is a flow diagram of an exemplary method for traffic forecasting. The exemplary method 200 begins at 202, and an input destination may be received and/or accepted at 204. At 206 in the example method 200, a route may be calculated based on the input destination, for example. According to one aspect, the route may be calculated from an origin location to the input destination. It will be appreciated that an input destination may be identified in a variety of ways. For example, an input destination may comprise a zip code, city, venue, event, etc. In one embodiment, the desired destination may comprise an event (e.g., rock concert, where a destination may be determined and/or inferred based upon a location, venue, etc. of the event), for example. In another embodiment, the input destination may be associated with a radius surrounding a current GPS location of a traveler, for example.

At 208, a predicted traffic pattern may be generated (e.g., based on historical traffic data, current traffic data, and/or predicted traffic data). In one embodiment, predicted traffic pattern may be indicative of an anticipated traffic status at a future time. For example, the predicted traffic pattern may be generated based on one or more future departure times (e.g., anticipated traffic fifteen minutes from a present time, half an hour from a present time, etc.). For example, if a roadway generally becomes congested around six o'clock, a predicted traffic pattern may be generated based on historical traffic data indicative of the six o'clock traffic jams. Multiple (e.g., one or more) future departure times may be utilized to facilitate generation of predicted traffic patterns and provide a spectrum of departure times for traveler consideration, for example. For example, a traveler may utilize a predicted traffic pattern to select a desirable departure time. To this end, a predicted traffic pattern may be based upon traffic pattern data comprising historical traffic data, current traffic data, and/or predicted traffic data, for example. Historical traffic data may comprise an analysis of underlying roadway traffic data based on geography, frequency of accidents and/or delays, construction, average traffic jam time, etc. In one embodiment, historic traffic data may be logged and/or tracked based on GPS signals received from travelers, for example. That is, for example, if GPS signals indicate that a large number of travelers (e.g., in automobiles equipped with GPS) are stationary and/or moving slowly on an interstate, historic traffic data and/or current traffic data may be logged indicating factors (e.g., a sporting event ended, time of day, day of the week, a report, overturned semi truck, school bus, etc.) associated with the traffic jam. As an example, if a school bus routinely drops children off from two to three o'clock, historical traffic data may be collected to reflect the school bus activity. In one embodiment, if the school bus is equipped with GPS equipment, current traffic data may be logged, updated, collected, and/or recorded in addition to the historical traffic data. Further, factors associated with the bus transportation may be recorded and/or associated with the historical traffic data. For example, if a state track meet is held annually at a location and at a time, GPS associated with the track meet transportation may be tagged and recorded (e.g., if a date for the track meet is changed to a new date, predicted traffic data may be updated accordingly upon notification of the change).

Current traffic data may be collected from a variety of sources, such as news and/or radio stations, for example. According to one aspect, current traffic data may be used to facilitate generation and/or analysis 210 of the predicted traffic pattern. For example, a predicted traffic pattern may be based upon a current traffic jam (e.g., current traffic data) and historical traffic jam clear times (e.g., historical traffic jam data) associated with a current day, location, month, weather condition, etc. That is, for example, if a traffic jam currently occupies a roadway (e.g., based on a sporting event), historical data pertaining to traffic associated with the sporting event may be used to generate a predicted traffic pattern (e.g., the sports traffic jams typically clears in twenty five minutes) to aid travelers with departure time decisions.

In one embodiment, a predicted traffic pattern for a route associated with an input location may be analyzed on a node by node basis, for example. According to one aspect, a route and/or traffic pattern data may be divided into one or more elements (e.g., by time interval, segments such as roadways, and/or by nodes). For example, if a traveler utilizes a first roadway and a second roadway to reach a destination, the predicted traffic pattern may be analyzed such that the first roadway comprises a first predicted traffic pattern (e.g. associated with a first time slot for the trip) and the second roadway comprises a second predicted traffic pattern (e.g., associated with a second time slot for a second segment of the trip). That is, for example, if a traveler is expected to spend a first hour (e.g., from one o'clock to two o'clock) on roadway A and a second hour (e.g., from two o'clock to three o'clock) travelling on roadway B, the predicted traffic pattern may be indicative of anticipated traffic on roadway A for the first time slot (e.g., from one o'clock to two o'clock) and also comprise a second portion of the predicted traffic pattern indicative of anticipated traffic on roadway B for the second time slot (e.g., from two o'clock to three o'clock).

At 212, one or more predicted traffic patterns may be displayed (e.g., as illustrated in FIG. 5) for one or more corresponding future departure times. For example, a traffic forecast may be provided for traffic along a route and/or traffic of an area in five minute intervals (e.g., or any other interval(s)). In one embodiment, a display for a predicted traffic pattern may comprise a color coded representation of traffic (e.g., red representing a higher traffic roadway, yellow representing an intermediate traffic roadway, and green representing a lower traffic roadway, for example).

A selection algorithm may be employed at 214 to facilitate suggestions for departure times, for example. In one embodiment, a traveler may provide a time window for leaving a location. For example, a traveler may indicate that he or she desires to leave work (e.g., a location) between four thirty and five thirty. A suggested departure time of four thirty may be provided based on one or more predicted traffic patterns associated with one or more corresponding departure times (e.g., a four thirty future departure time, a five o'clock future departure time, and/or a five thirty future departure time). To this end, the five thirty and/or six o'clock future departure times may be associated with an hour of travel time, while the four thirty future departure time may merely be associated with a forty five minute segment of travel time. Therefore, a suggested departure time of four thirty may be provided for this example. In another embodiment, the selection algorithm may be configured to provide suggested departure times 214 based on traveler preferences (e.g., stopping for dinner, etc.). According to one aspect, if a traveler is en route to a destination, a suggested break may be provided. For example, if a traveler is sitting in traffic, at a current location, and it is determined that a predicted traffic pattern may result in a half hour travel time (e.g., due to an accident, such as an overturned semi truck) to a destination regardless of the traveler's actions (e.g., continuing to sit and wait in traffic or stopping to take a break), a suggested break may be provided. To this end, a traveler may take a suggested break and continue his or her journey (e.g., potentially without a travel time penalty), for example. The selection algorithm may account for a similar arrival time scenario comprising a first scenario where a traveler leaves at a first anticipated departure time of five o'clock and has an anticipated arrival time of six o'clock and a second scenario where a traveler leaves at a second anticipated departure time of five thirty and has a similar anticipated arrival time of six o'clock. To this end, the selection algorithm may provide a traveler with a suggested departure time of five thirty to promote a more desirable (e.g., faster) commute time, for example.

In one embodiment, a suggested speed may be provided for a route and/or segments associated with the route. For example, traffic data may comprise data pertaining to traffic light timing, and it may be determined that traveling at a suggested speed may enable a traveler to flow (e.g., keep moving) through traffic lights (e.g., rather than constantly speeding up and stopping), for example. In one embodiment, a suggested increase and/or decrease in speed may be provided to facilitate navigation.

In one embodiment, if a traveler indicates an acceptance of a suggested departure time (e.g. and/or follows the suggested departure time), the suggested departure time may be associated 216 with predicted traffic data. For example, if hundreds of travelers receive a same suggested departure time and a route comprising a roadway common to the travelers, predicted traffic data may be updated to reflect anticipated traffic based on acceptance of the suggested departure times, for example. In another example, predicted traffic data and/or current traffic data may be updated and/or verified based upon GPS signals and/or devices. For example, if a traveler routinely accepts a suggested departure time, but often fails to follow the suggested departure time, predicted traffic data may be updated with regard to a tendency of the traveler. As another example, if a traveler is following a suggested departure time, current traffic patterns, and/or current traffic data may be updated accordingly. To this end, suggested departure times may be associated 216 with predicted traffic patterns of 208 and/or current traffic patterns at 210. The exemplary method 200 ends at 218 thereafter.

Figure 3:
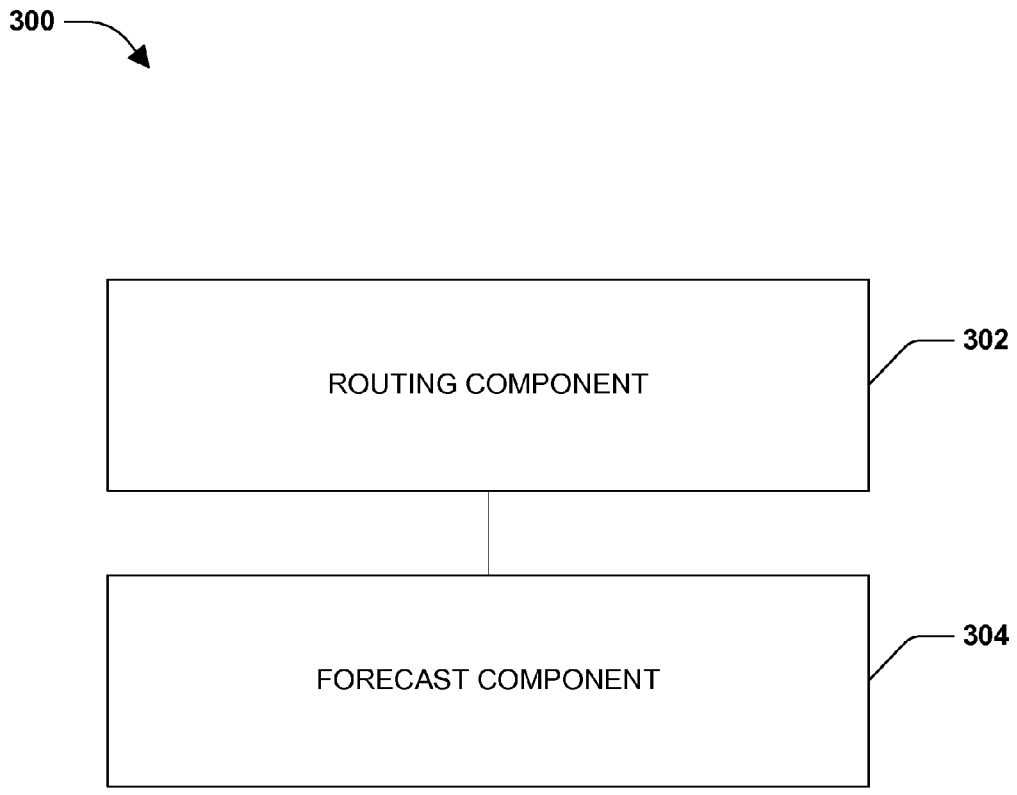
FIG. 3 is a component diagram of an exemplary system for traffic forecasting.

FIG. 3 is a component diagram of an exemplary system for traffic forecasting. A routing component 302 may be configured to receive an input location. In one embodiment, the routing component may calculate a route from a first location to the input location, for example. In one embodiment, the input location may be entered as an event. That is, for example, if a band is touring the country, and a traveler enters the band as a destination, a current city (e.g., associated with a tour of the band) the band is playing in may be inferred as the destination. For example, if Rock Band plays in Cleveland, Ohio at a First Arena on Monday and Cincinnati, Ohio at a Second Arena on Tuesday, a traveler may be provided with a traffic forecast to the First Arena if Rock Band concert is entered as an input location on Monday, while a traffic forecast to the Second Arena may be provided if Rock Band is entered as the input location on Tuesday. To this end, an event entered as a destination may be associated with a location for the event based on an event schedule, for example.

A forecast component 304 may be configured to provide a predicted traffic pattern associated with the input location, for example. Forecast component 304 may be configured to provide the predicted traffic pattern for an area and/or a route associated with the input location as a destination, for example.

Figure 4:
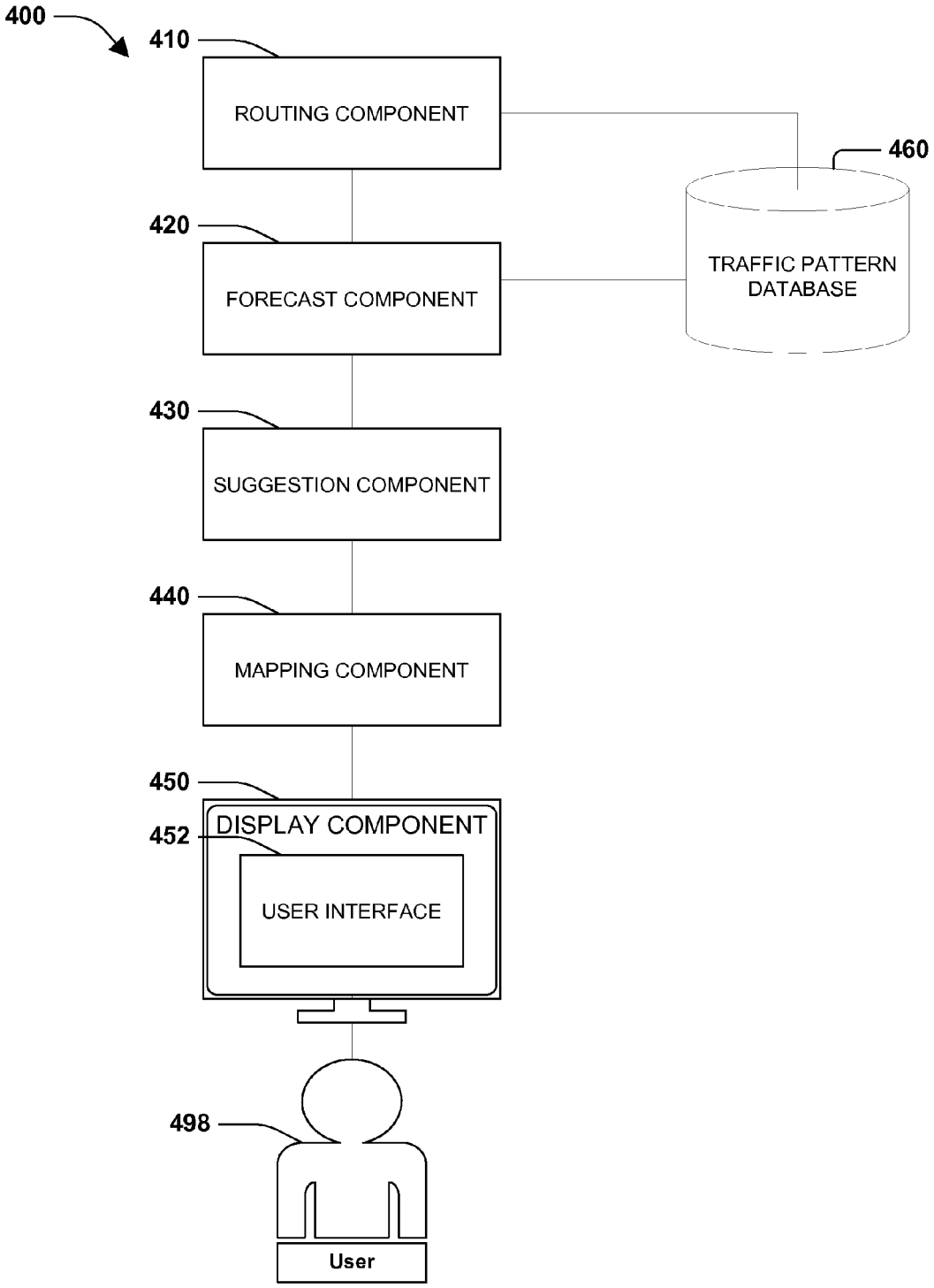
FIG. 4 is a component diagram of an exemplary system for traffic forecasting.

FIG. 4 is a component diagram of an exemplary system for traffic forecasting. A routing component 410 may be configured to receive an input location (e.g., from user 498), for example.

A forecast component 420 may be configured to provide one or more predicted traffic patterns associated with one or more corresponding future departure times.

Suggestion component 430 may be configured to suggest a suggested departure time to user 498, for example. In one embodiment, a traveler may indicate a preference for historical data used to generate a predicted traffic pattern. In one embodiment, a traveler may desire to utilize historical data from a past week, past month, similar weather condition, and/or past year to provide alternative sets of predicted traffic patterns (e.g., associated with respective future departure times), for example.

A mapping component 440 may be configured to generate a map comprising at least some of the predicted traffic patterns to facilitate visualizations of at least some of the traffic patterns for the user 498. In one embodiment, mapping component 440 may be configured to generate a color coded map comprising a legend (e.g., red may represent a busier roadway and green may represent a less busy roadway). According to one aspect, predicted traffic patterns may be displayed by the mapping component 440 in response to a click of a mouse or a swipe of a touch screen, for example. For example, a first traffic pattern for a first point in time may be displayed in response to a first swipe, a second traffic pattern for a second point in time may be displayed in response to a second swipe, and a third, fourth, etc. Time intervals between different points in time for which traffic patterns are displayed may be ascertained in any number of manners, such as by user input, according to a default setting, automatically/dynamically based upon variations in traffic patterns (e.g., if traffic patterns are not expected to change in five minutes, then time intervals may be greater than five minutes to provide more useful information to a user, as opposed to a seemingly static traffic patterns). In one embodiment, a traveler may determine a desired departure time based on at least some of the predicted traffic patterns. In another embodiment, the mapping component 440 may provide the user 498 with the suggested departure time generated by suggestion component 430.

A display component 450 may comprise a user interface 452, and the display component 450 may be configured to display predicted traffic patterns (e.g., as illustrated in FIG. 5), suggested departure times, future departure times (e.g., and associated travel times etc.), and/or turn by turn directions for the traveler 498. The display component 450 may display current and/or predicted traffic patterns for an area and/or a route (e.g., specific to a traveler), for example. In one embodiment, display component may be configured to provide one or more pairs of estimated departure and/or arrival times from an origin location to a destination (e.g. input) location, for example.

Traffic pattern database 460 may comprise traffic data, current traffic data, historical traffic data, and/or predicted traffic data, etc. In one embodiment, traffic pattern database 460 may collect and/or aggregate traffic data from GPS devices, for example. It will be appreciated that any of the components of FIG. 3 and/or FIG. 4 may be configured to implement any of the acts of FIG. 1 and/or FIG. 2, for example.

FIG. 5 illustrates an exemplary embodiment of a predicted traffic pattern 500. At 502, time indicator A may be displayed comprising information related to a route and/or an input location, for example. In one embodiment, time indicator A 502 may comprise a current time, an estimated departure time, a future departure time, and/or an estimated travel time, for example. A combination of 504 and/or 506 may represent a status of traffic activity for a roadway associated with time indicator 502 A, for example. In one embodiment, 504 may represent slower and/or congested traffic (e.g., based on dashed lines) on a first portion of a roadway while 506 may represent a less congested portion of the roadway (e.g., based on solid lines). Time indicator B 512 may represent a departure time different than a departure time associated with time indicator A 502. In one embodiment, the time associated with time indicator B 512 may be fifteen minutes later (e.g., four fifteen) than a time (e.g. four o'clock) associated with time indicator A 502. It will be appreciated a (e.g., estimated) congested portion of traffic 514 and/or a less congested portion 516 may change based on a passage of time (e.g., a time difference between time indicator A 502 and time indicator B 512). Therefore, a traveler may make an informed decision based upon the predicted traffic pattern 500. For example more desirable (e.g., faster, smaller overall duration, etc.) travel may be experienced if travel is associated with (e.g., commenced at) time A than time B (e.g., because of the amount of lesser congestion 506 as compared to 516). In this way, traffic forecasting may be provided.

FIG. 6 illustrates an example user interface 600 (e.g., 452 in FIG. 4) for displaying forecasted traffic, such as on a mobile device 610 (e.g., a cellular telephone, tablet, laptop computer, etc.), for example. More particularly, FIG. 6 illustrates how two or more maps 602, 606, and 608 may be concurrently displayed in the user interface 600. Respective maps 602, 606, and 608, which may depict a same or similar region (e.g., depict the same or similar roads, pathways, etc. spatially approximate an input location (e.g., a same zoom level)), are configured to illustrate real-time and/or future traffic information at different times of day. For example, a first map 602 may display current traffic patterns within a given region (e.g., as determined by a user's present location (e.g., represented on the map as a triangle 604)) and one or more other maps 606 and 608 may display predicted, traffic patterns within the given region at other times of day. By way of example, a second map 606 illustrates traffic patterns at 6:15 (e.g., 15 minutes from now) and a third map 608 illustrates traffic patterns at 6:30 (e.g., 30 minutes from now). In this way, a user may compare/contrast two or more maps to determine whether it is better to travel to a given location now or to wait 15/30 minutes, for example, while traffic subsides (e.g., to reduce travel time).

By way of example, suppose that it is approximately 6 pm and a user is interested in visiting a local restaurant. The user may launch an application, causing the application to display a user interface, such as the user interface 600 described in FIG. 6, for example. A location of the user, or rather the user's device, may be determined and the user may be presented with a plurality of maps 602, 606, and 608. The maps 602, 606, and 608 may illustrate traffic patterns within a region surrounding the user's determined location (e.g., based upon GPS of the user's device). For example, as illustrated herein, three maps 602, 606, and 608 (e.g., which may also be referred to as tiles) are presented to the user respectively depicting traffic patterns at different times. For example, in the illustrated embodiment, the maps 602, 606, and 608 illustrate traffic patterns in 15 minute increments (although other increments are contemplated herein). Thus, a first map 602 illustrates current traffic patterns for the region (e.g., based upon real-time, historical, and/or predicted data), a second map 606 illustrates expected traffic patterns for the region at 6:15, 15 minutes from now, and a third map 608 illustrates expected traffic patterns for the region at 6:30, 30 minutes from now.

It will be appreciated that moderate and heavy traffic patterns are illustrated in the example maps 602, 604, 606 via patterned lines. For example, heavy traffic may be represented by dash-dotted lines and moderate traffic may be represented by dotted lines. However, other graphical representations of light, moderate, and/or heavy traffic patterns are also contemplated. For example, in one embodiment, roads with light traffic patterns may be shaded green while roads with moderate traffic patterns are shaded yellow and roads with heavy traffic patterns are shaded red.

In the maps 602, 606, and 608 illustrated with respect to FIG. 6, it appears that traffic continues to get heavier as time passes. For example, at 6:15, a larger portion of the middle vertical line is dotted, meaning a greater amount of the road has moderate traffic. Moreover, at 6:30, a portion of the bottom horizontal line is dotted, meaning traffic is expected to increase on that portion of the road by 6:30. As such, if a user were determining whether to leave at 6, 6:15, or 6:30, the user may determine it is best to leave now, at 6, before traffic becomes worse.

In one embodiment, the user interface 600 may further comprise an enlarged map section 610 configured to display an enlarged view of one or more of the maps 602, 606, and 608. For example, in the illustrated embodiment of the user interface 600, the map 602 labeled "now" is displayed in the enlarged map section 610. Based upon an indication of a desire to enlarge a different one of the displayed maps 602, 606, and 608, the map displayed in the enlarged map section 610 may change. For example, a user may indicate a selection of a different map (e.g., by swiping, dragging, doubling tapping, etc. on one or more of the displayed maps 602, 606, and 608), and the user interface 600 may present the selected map in the enlarged map section 610. However, other techniques for enlarging and/or shrinking a map are also contemplated. For example, in another example, maps may be enlarged via a fish-eye technique. As an example, a user may place a finger over the upper left portion of the user interface 600, causing the map labeled "now" to be enlarged. If an indication indicative of the finger sliding across the screen (e.g., from left to right) is received, the user interface 600 may enlarge/shrink respective maps based upon the movement (e.g., such that the map represented in a region nearest the region of the finger comprises the greatest enlargement), for example.

It will be appreciated that although the example user interface 600 provides for concurrently displaying three maps, fewer than three or more than three maps may be displayed within the user interface and may depend upon, among things, the screen size of the device displaying the user interface 600. For example, a user interface 600 presented on a cellular telephone may present merely two maps concurrently while a user interface 600 presented on a tablet device (e.g., which may have a much larger screen) may present four or more maps concurrently. Further, in one embodiment, the maps 602, 606, and 608 may be presented in a slider, for example, and the user can drag one or more of the maps 602, 606, and 608 off the display, for example, causing the user interface 600 to display additional, new maps. For example, if a user wanted to view a map of predicted traffic at 6:45, the user may drag the map 602 labeled "now" to the left of the user interface 600 (e.g., causing it to appear as though it dropped off the display) and a map of predicted traffic at 6:45 may be presented to the right of the map 608 labeled "6:30." It may be appreciated that the size of respective maps within the user interface 600 and/or the availability of an enlarged map section 610 may depended upon screen size as well, for example.

In one embodiment, the maps presented in the user interface may be personalized to a user based upon more than the input location. FIG. 7 illustrates an example user interface 700 for displaying two or more maps concurrently. More specifically, the user interface 700 displays maps 702, 704, and 706 that are further customized based upon additional information about the user (e.g., such as a user's desired beginning/ending location) relative to the maps 702, 704, 706 displayed with respect to the user interface 700 of FIG. 7. For example, suppose a user entered into the user interface 700 his/her current location as a beginning point and specified a destination (e.g., such as by name or location). Based upon this information, maps 702, 704, and 706 may be displayed that merely illustrate roads a user may travel to reach the specified destination (e.g., as represented by a flag 708) and/or may merely illustrate a region inclusive of the beginning location and the destination (e.g., reducing 'noise' of traffic on other roads, routes, etc. that the user is not interested in).

Moreover, the user interface 700 may present information about an expected time of arrive at destination if the user leaves at a given time. For example, at illustrated with respect to the map 702 illustrating present traffic conditions, a user that leaves now (e.g., at 6:00) may be expected to arrive at his/her destination at 6:45 based upon current travel conditions and an identified route of travel (e.g., which may include the fastest route given traffic information and/or the shortest route based upon mileage, for example). However, if the user were to leave at 6:15, it may be predicted that the user would arrive at his/her destination at 6:50 based upon predicted future traffic considerations (e.g., meaning a total travel time of 35 minutes, which is less than the 45 minutes of travel time predicted if the user left now, at 6) as shown by the map 704 illustrating traffic patterns at 6:15.

Moreover, as illustrated with respect to FIG. 6, the user interface 700 may further comprise an enlarged map section 710 wherein one or more of the maps 702, 704, and 706 presented within the user interface 700 may be enlarged for an improved/enlarged view of the traffic patterns at the given/selected time, for example.

It will be appreciated that the personalization of maps displayed in a user interface may be based upon numerous factors, such as those factors described above which may be taken into consideration when predicting future traffic, for example. By way of example and not limitation, information pertaining to a user's desired time of travel, pertaining to a specified arrival time and/or arrival timeframe (e.g., where a user specifies the he/she must arrive between 6 and 6:15 pm), pertaining to other user specified parameters, and/or pertaining to weather considerations, for example, may affect the number of maps presented within a user interface and/or the layout of such maps, for example. By way of example, if a user intention to arrive at the location between 6 and 6:15 pm is received, the user interface may provide maps to the user that are incremented by 5 minutes (e.g., a first map illustrates current traffic patterns, a second map illustrates traffic patterns that are predicted in five minutes, etc.). If a user intention to arrive at a location between 6 and 7 pm is received (e.g., allowing greater flexibility in the arrival time) maps that are incremented by 15 minutes may be presented in the user interface 700. As another example, if a storm is predicted in the region at 7 pm, the maps that are displayed in the user interface may represent predicted traffic patterns at increments before 7 pm, when possible, to assist the user in arriving at his/her location before the 7 pm storm. It may be appreciated that other considerations may also be factored in when determining the increments of time between maps and/or when determined times for forecasting traffic.

FIG. 8 illustrates yet another embodiment of a user interface 800 for concurrently displaying two or more maps 802, 804, and 806, including at least one map that illustrates predicted traffic patterns at a time in the future. More particularly, in such an embodiment, one or more of the maps, such as the map 804 illustrating expected traffic patterns at 6:15 may be displayed in its entirety, for example, while merely portions of one or more other maps 802 and 806 are displayed. In such an embodiment, the user interface 800 may increase the viewable area of a first map while decreasing the viewable area of another map, for example, based upon receipt of an intention to view a different map. By way of example, a user may slide his/her finger left or right on the screen (e.g., as shown by the arrow 808). If an indication of the user moving his/her finger to the right is received, the map 806 showing predicted traffic patterns at 6:30 may come further into view (e.g., causing the portion of map 806 that is displayed to increase) while decreasing the portion of the map 802 showing current traffic patterns (e.g., such that it disappears entirely from the user interface 800).

It will be appreciated that FIGS. 6-8 are merely intended to describe example interfaces for displaying two or more maps currently (e.g., as thumbnails), where at least one of the maps is based upon predicted future traffic patterns. For example, instead of the maps being oriented in a horizontal row as illustrated in FIGS. 6-8, one or more of the maps may be oriented in a vertical column, diagonal and/or a checkerboard pattern, for example. Moreover, although the user interfaces illustrated in FIGS. 6-8 illustrate at least one map providing for current traffic patterns, it will be appreciated that in another embodiment, none of the displayed maps may illustrate current traffic patterns. By way of example, a user may specify within the user interface a range of time, and maps may be generated that illustrate future traffic patterns that fall within the specified range of time. Thus, the user interface may be customizable based upon, among other things, the time of day when the maps are viewed, weather consideration, user parameters, default parameters, etc.

Figure 9:
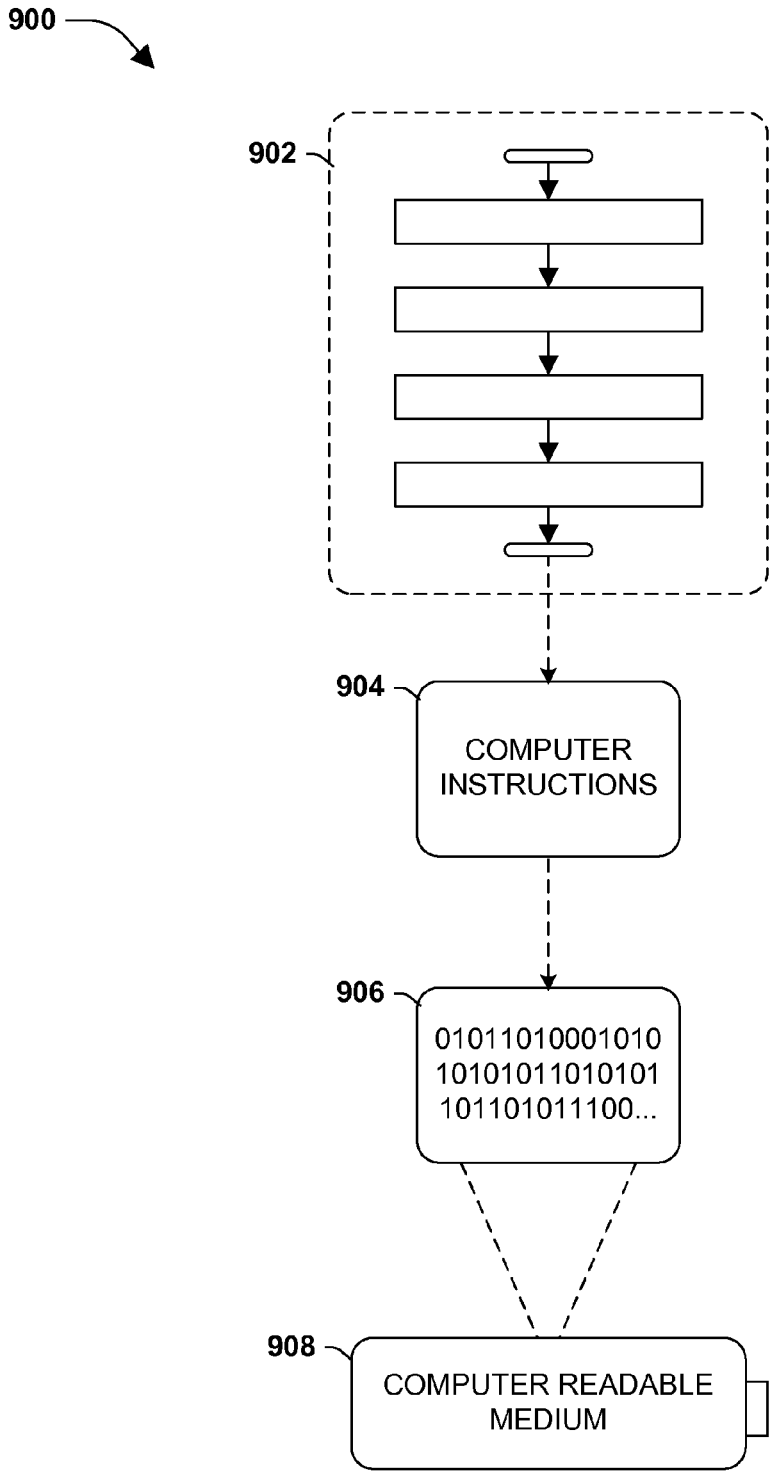
FIG. 9 is an illustration of an exemplary computing environment where one or more of the provisions set forth herein may be implemented.

Still another embodiment involves a computer-readable medium comprising processor-executable instructions configured to implement one or more of the techniques presented herein. An exemplary computer-readable medium that may be devised in these ways is illustrated in FIG. 9, wherein the implementation 900 comprises a computer-readable medium 608 (e.g., a CD-R, DVD-R, or a platter of a hard disk drive), on which is encoded computer-readable data 906. This computer-readable data 606 in turn comprises a set of computer instructions 904 configured to operate according to one or more of the principles set forth herein. In one such embodiment 902, the processor-executable instructions 904 may be configured to perform a method, such as at least some of the exemplary methods 100 and/or 200 of FIGS. 1 and 2, respectively, for example. In another such embodiment, the processor-executable instructions 904 may be configured to implement a system, such as at least some of the exemplary systems 300 and/or 400 of FIGS. 3 and 4, respectively, for example. Many such computer-readable media may be devised by those of ordinary skill in the art that are configured to operate in accordance with the techniques presented herein.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

As used in this application, the terms "component", "module," "system", "interface", and the like are generally intended to refer to a computer-related entity, either hardware, a combination of hardware and software, software, or software in execution. For example, a component may be, but is not limited to being, a process running on a processing unit, a processing unit, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers.

Furthermore, the claimed subject matter may be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, carrier, or media. Of course, those skilled in the art will recognize many modifications may be made to this configuration without departing from the scope or spirit of the claimed subject matter.

Figure 10:
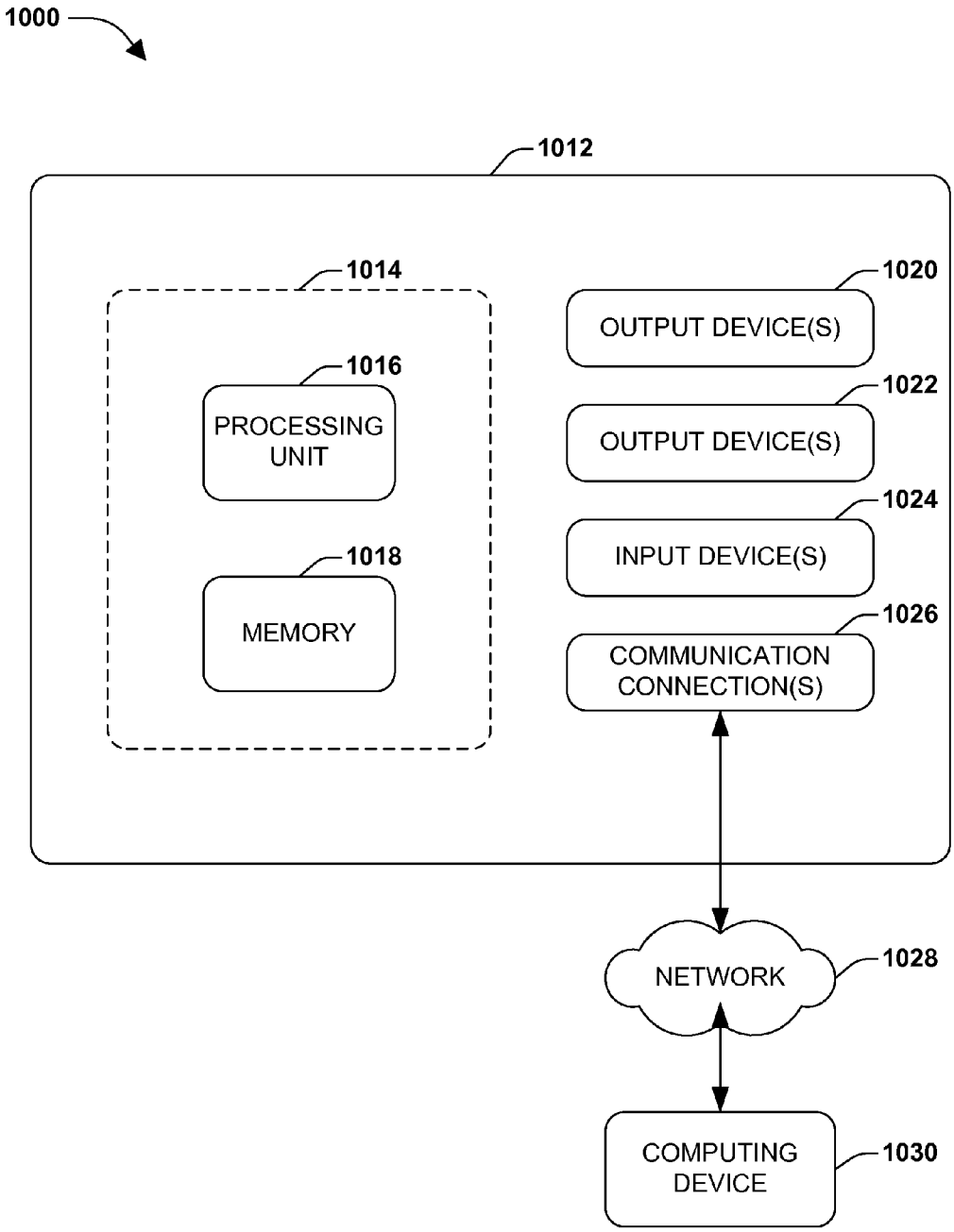
FIG. 10 is an illustration of an exemplary computer-readable medium (e.g., device) comprising processor-executable instructions configured to embody one or more of the provisions set forth herein.

FIG. 10 and the following discussion provide a brief, general description of a suitable computing environment to implement embodiments of one or more of the provisions set forth herein. The operating environment of FIG. 10 is only one example of a suitable operating environment and is not intended to suggest any limitation as to the scope of use or functionality of the operating environment. Example computing devices include, but are not limited to, personal computers, server computers, hand-held and/or laptop devices, mobile devices (such as mobile phones, Personal Digital Assistants (PDAs), media players, and the like), multiprocessor systems, consumer electronics, mini computers, mainframe computers, distributed computing environments that include any of the above systems or devices, and the like.

Although not required, embodiments are described in the general context of "computer readable instructions" being executed by one or more computing devices. Computer readable instructions may be distributed via computer readable media (discussed below). Computer readable instructions may be implemented as program modules, such as functions, objects, Application Programming Interfaces (APIs), data structures, and the like, that perform particular tasks or implement particular abstract data types. Typically, the functionality of the computer readable instructions may be combined or distributed as desired in various environments.

FIG. 10 illustrates an example of a system 1010 comprising a computing device 1012 configured to implement one or more embodiments provided herein. In one configuration, computing device 1012 includes at least one processing unit 1016 and memory 1018. Depending on the exact configuration and type of computing device, memory 1018 may be volatile (such as RAM, for example), non-volatile (such as ROM, flash memory, etc., for example), or some combination of the two. This configuration is illustrated in FIG. 10 by dashed line 1014.

In other embodiments, device 1012 may include additional features and/or functionality. For example, device 1012 may also include additional storage (e.g., removable and/or non-removable) including, but not limited to, magnetic storage, optical storage, and the like. Such additional storage is illustrated in FIG. 10 by storage 1020. In one embodiment, computer readable instructions to implement one or more embodiments provided herein may be in storage 1020. Storage 1020 may also store other computer readable instructions to implement an operating system, an application program, and the like. Computer readable instructions may be loaded in memory 1018 for execution by processing unit 1016, for example.

The term "computer readable media" as used herein includes computer storage media. Computer storage media includes volatile and nonvolatile, removable and non-removable media implemented in any method or technology for storage of information such as computer readable instructions or other data. Memory 1018 and storage 1020 are examples of computer storage media. Computer storage media includes, but is not limited to, RAM, ROM, EEPROM, flash memory or other memory technology, CD-ROM, Digital Versatile Disks (DVDs) or other optical storage, magnetic cassettes, magnetic tape, magnetic disk storage or other magnetic storage devices, or any other medium which can be used to store the desired information and which can be accessed by device 1012. Any such computer storage media may be part of device 1012.

Device 1012 may also include communication connection(s) 1026 that allows device 1012 to communicate with other devices. Communication connection(s) 1026 may include, but is not limited to, a modem, a Network Interface Card (NIC), an integrated network interface, a radio frequency transmitter/receiver, an infrared port, a USB connection, or other interfaces for connecting computing device 1012 to other computing devices. Communication connection(s) 1026 may include a wired connection or a wireless connection. Communication connection(s) 1026 may transmit and/or receive communication media.

The term "computer readable media" may include communication media. Communication media typically embodies computer readable instructions or other data in a "modulated data signal" such as a carrier wave or other transport mechanism and includes any information delivery media. The term "modulated data signal" may include a signal that has one or more of its characteristics set or changed in such a manner as to encode information in the signal.

Device 1012 may include input device(s) 1024 such as keyboard, mouse, pen, voice input device, touch input device, infrared cameras, video input devices, and/or any other input device. Output device(s) 1022 such as one or more displays, speakers, printers, and/or any other output device may also be included in device 1012. Input device(s) 1024 and output device(s) 1022 may be connected to device 1012 via a wired connection, wireless connection, or any combination thereof. In one embodiment, an input device or an output device from another computing device may be used as input device(s) 1024 or output device(s) 1022 for computing device 1012.

Components of computing device 1012 may be connected by various interconnects, such as a bus. Such interconnects may include a Peripheral Component Interconnect (PCI), such as PCI Express, a Universal Serial Bus (USB), firewire (IEEE 1394), an optical bus structure, and the like. In another embodiment, components of computing device 1012 may be interconnected by a network. For example, memory 1018 may be comprised of multiple physical memory units located in different physical locations interconnected by a network.

Those skilled in the art will realize that storage devices utilized to store computer readable instructions may be distributed across a network. For example, a computing device 1030 accessible via network 1028 may store computer readable instructions to implement one or more embodiments provided herein. Computing device 1012 may access computing device 1030 and download a part or all of the computer readable instructions for execution. Alternatively, computing device 1012 may download pieces of the computer readable instructions, as needed, or some instructions may be executed at computing device 1012 and some at computing device 1030.

Various operations of embodiments are provided herein. In one embodiment, one or more of the operations described may constitute computer readable instructions stored on one or more computer readable media, which if executed by a computing device, will cause the computing device to perform the operations described. The order in which some or all of the operations are described should not be construed as to imply that these operations are necessarily order dependent. Alternative ordering will be appreciated by one skilled in the art having the benefit of this description. Further, it will be understood that not all operations are necessarily present in respective embodiment provided herein.

Moreover, the word "exemplary" is used herein to mean serving as an example, instance, or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims may generally be construed to mean "one or more" unless specified otherwise or clear from context to be directed to a singular form. Also, at least one of A and B or the like generally means A or B or both A and B.

Although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure. In addition, while a particular feature of the disclosure may have been disclosed with respect to only one of several implementations, such feature may be combined with one or more other features of the other implementations as may be desired and advantageous for any given or particular application. Furthermore, to the extent that the terms "includes", "having", "has", "with", or variants thereof are used in either the detailed description or the claims, such terms are intended to be inclusive in a manner similar to the term "comprising".

What is claimed is:

1. A method for forecasting traffic, comprising:

receiving an input location;

generating a first predicted traffic pattern for the input location and a second predicted traffic pattern for the input location based at least in part on traffic data associated with the input location, the first predicted traffic pattern indicative of predicted traffic at a first instance of time and the second predicted traffic pattern indicative of predicted traffic at a second instance of time; and concurrently presenting within a user interface at least two maps displaying traffic patterns for the input location, a first map of the at least two maps corresponding to the first predicted traffic pattern and a second map of the at least two maps corresponding to the second predicted traffic pattern, at least one of the receiving the input location, the generating the first predicted traffic pattern and the second predicted traffic pattern, or the concurrently presenting within the user interface at least two maps implemented at least in part via a processing unit.

2. The method of claim 1, the concurrently presenting within the user interface at least two maps comprising displaying a third map of the at least two maps corresponding to a current traffic pattern.

3. The method of claim 1, at least some of the traffic data comprising at least one of historical traffic data, current traffic data, or predicted traffic data.

4. The method of claim 1, comprising generating the first predicted traffic pattern in response to at least one of a swipe or a click.

5. The method of claim 1, comprising calculating a route based at least in part on the input location.

6. The method of claim 1, the traffic data describing vehicle volume along one or more routes.

7. The method of claim 1, comprising generating the first predicted traffic pattern based at least in part on a future departure time.

8. The method of claim 1, comprising collecting at least some of the traffic data from a global positioning system (GPS).

9. A system for forecasting traffic, comprising:

a routing component configured to receive an input location; and a forecast component configured to generate a first predicted traffic pattern for the input location and a second predicted traffic pattern for the input location based at least in part on traffic data associated with the input location for concurrent presentation within a user interface, the first predicted traffic pattern indicative of predicted traffic at a first instance of time and the second predicted traffic pattern indicative of predicted traffic at a second instance of time, at least one of the routing component or the forecast component implemented at least in part via a processing unit.

10. The system of claim 9, the input location comprising a destination.

11. The system of claim 9, the input location comprising a route.

12. The system of claim 9, at least some of the traffic data comprising at least one of historical traffic data, current traffic data, or predicted traffic data.

13. The system of claim 9, the forecast component configured to generate the first predicted traffic pattern in response to at least one of a swipe or a click.

14. The system of claim 9, the routing component configured to calculate a route based at least in part on the input location.

15. A non-transitory computer-readable storage medium comprising computer-executable instructions, which when executed at least in part via a processing unit performs acts, comprising:

receiving an input location;

generating a first predicted traffic pattern for the input location and a second predicted traffic pattern for the input location based at least in part on traffic data associated with the input location, the first predicted traffic pattern indicative of predicted traffic at a first instance of time and the second predicted traffic pattern indicative of predicted traffic at a second instance of time; and concurrently presenting within a user interface at least two maps displaying traffic patterns for the input location, a first map of the at least two maps corresponding to the first predicted traffic pattern and a second map of the at least two maps corresponding to the second predicted traffic pattern.

16. The non-transitory computer-readable storage medium of claim 15, the input location comprising a destination.

17. The non-transitory computer-readable storage medium of claim 15, the input location comprising an area.

18. The non-transitory computer-readable storage medium of claim 15, at least some of the traffic data comprising at least one of historical traffic data, current traffic data, or predicted traffic data.

19. The non-transitory computer-readable storage medium of claim 15, the concurrently presenting within the user interface at least two maps comprising displaying a third map of the at least two maps corresponding to a current traffic pattern.

20. The non-transitory computer-readable storage medium of claim 15, the input location comprising at least one of a route or a destination.

* * * * *